US006943329B2

(12) United States Patent
Ring

(10) Patent No.: US 6,943,329 B2
(45) Date of Patent: Sep. 13, 2005

(54) INDUCTION HEATING SYSTEM FOR REDUCED SWITCH STRESS

(75) Inventor: Edmund J. Ring, Circle Pines, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 17 days.

(21) Appl. No.: 10/671,063

(22) Filed: Sep. 25, 2003

(65) Prior Publication Data

US 2005/0067409 A1 Mar. 31, 2005

(51) Int. Cl.[7] ..... H05B 6/04
(52) U.S. Cl. ..... 219/661
(58) Field of Search ..... 219/600, 626–634, 219/660–668; 363/49, 172; 373/139, 148

(56) References Cited

U.S. PATENT DOCUMENTS

| | | | | |
|---|---|---|---|---|
| 3,745,378 A | * | 7/1973 | Pritchett | 327/452 |
| 4,016,391 A | | 4/1977 | Kiuchi et al. | |
| 4,017,701 A | | 4/1977 | Mittelmann | |
| 4,074,101 A | | 2/1978 | Kiuchi et al. | |
| 4,092,510 A | | 5/1978 | Kiuchi et al. | |
| 4,277,667 A | | 7/1981 | Kiuchi | |
| 4,355,222 A | | 10/1982 | Geithman et al. | |
| 4,358,654 A | * | 11/1982 | Estes | 219/663 |
| 4,359,620 A | | 11/1982 | Keller | |
| 4,413,231 A | | 11/1983 | Amedro et al. | |
| 4,511,781 A | | 4/1985 | Tucker et al. | |
| 4,617,442 A | * | 10/1986 | Okuda | 219/663 |
| 4,931,609 A | * | 6/1990 | Aoki | 219/492 |
| 5,138,136 A | | 8/1992 | Moreau et al. | |
| 5,374,809 A | | 12/1994 | Fox et al. | |
| 5,414,247 A | | 5/1995 | Geithman et al. | |
| 5,504,309 A | | 4/1996 | Geissler | |
| 5,536,920 A | | 7/1996 | Kwon | |
| 5,752,148 A | | 5/1998 | Yoneda et al. | |
| 5,789,721 A | | 8/1998 | Hayashi et al. | |
| 6,016,257 A | * | 1/2000 | Chang et al. | 363/17 |
| 6,124,581 A | * | 9/2000 | Ulrich | 219/665 |
| 6,288,375 B1 | | 9/2001 | Lappi et al. | |

FOREIGN PATENT DOCUMENTS

| | | |
|---|---|---|
| WO | WO 01/30117 | 4/2001 |

* cited by examiner

*Primary Examiner*—Tu Hoang
(74) *Attorney, Agent, or Firm*—Pamela L. Stewart

(57) ABSTRACT

An induction heating system is provided. The induction heating system comprises a power switch, a resonant heating circuit, and a pulse initiator. The resonant heating circuit is configured to generate an oscillating voltage in response to a DC pulse input. The pulse initiator is positioned across the power switch and configured to monitor a voltage across the power switch and to initiate application of a subsequent DC pulse to the resonant heating circuit upon detecting a substantially zero voltage crossing at the power switch during a first cycle of the oscillating voltage.

23 Claims, 3 Drawing Sheets

INDUCTION HEATING SYSTEM FOR REDUCED SWITCH STRESS

TECHNICAL FIELD

The present invention relates generally to an induction heating system and more particularly to an induction heating system utilizing a pulse initiator to provide efficient heating with minimal switch stress.

BACKGROUND OF THE INVENTION

The term "induction heating" generally describes a process in which an alternating current is passed through a coil to generate an alternating magnetic flux. When the coil is placed in close proximity to or wrapped around a metallic object that is to be heated, the alternating magnetic flux inductively couples the load to the coil and generates eddy currents within the metallic object causing it to become heated. Because of its function, the coil is often referred to as a "work coil" or "induction head," and the metallic object to be heated as a "load." Induction heating may be used for many purposes including curing adhesives, hardening of metals, brazing, soldering, welding, and other fabrication processes in which heat is a necessary agent or catalyst.

The field of induction heating is considered to be well-established, with several types of induction heating systems having been developed to control power delivered to the induction head and, thus, the heat produced in the load. One type of induction heating system, sometimes referred to as a resonant system, generally comprises a power supply, a resonant induction head typically formed by the work coil and a capacitor, and some type of switching means to control delivery of power to the resonant induction head by the power supply. Generally, the switching means is closed to cause the power supply to provide a current to the resonant induction head resulting in energy being stored in the work coil. When the switching means is opened, the induction head begins to resonant and generate an oscillating voltage and corresponding oscillating current, and the stored energy is discharged to the load as heat.

The greatest amount of energy is transferred from the induction head to the load during the first half-cycle of oscillation. Thus, to provide the quickest and most efficient heating of loads, conventional induction heating systems are often configured to replenish the stored energy to the induction head by operating the switching means when the oscillating voltage reaches zero at the end of the first half-cycle. However, this often does not coincide with a zero voltage at the switching means resulting in potential stress to the switching means, or requires complicated switching means to do so.

Induction heating systems, particularly those employing resonant induction heads, would benefit from a simplified scheme that substantially minimizes stress to the switching means while still providing quick and efficient load heating.

SUMMARY OF THE INVENTION

The present invention provides an induction heating system. The induction heating system comprises a power switch, a resonant heating circuit, and a pulse initiator. The resonant heating circuit is configured to generate an oscillating voltage in response to a DC pulse input. The pulse initiator is positioned across the power switch and configured to monitor a voltage across the power switch and to initiate application of a subsequent DC pulse to the resonant heating circuit upon detecting a substantially zero voltage across the power switch during a first cycle of the oscillating voltage.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures.

DETAILED DESCRIPTION

Figure 1:
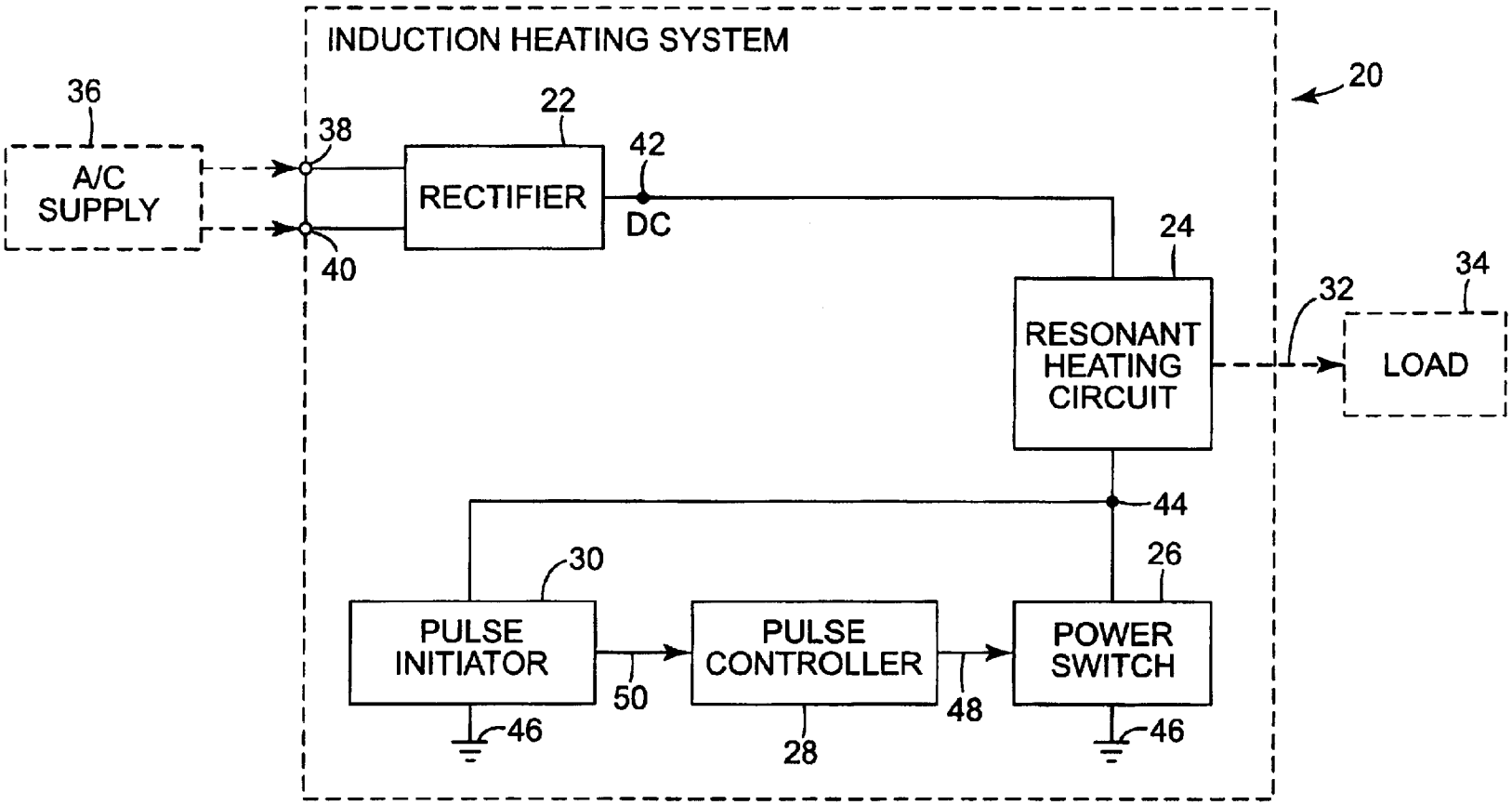
FIG. 1 is a block diagram illustrating one exemplary embodiment of an induction heating system according to the present invention.

In FIG. 1, an induction heating system in accordance with the present invention is generally indicated at 20. Induction heating system 20 includes a rectifier 22, a resonant heating circuit 24, a power switch 26, a pulse controller 28, and a pulse initiator 30. Induction heating system 20 is configured to be inductively coupled at 32 to an external electrically conductive load 34 and operates to control the switching of power switch 26 so as to provide substantially maximum heating of load 34 while concurrently substantially minimizing switching stress of power switch 26.

Rectifier 22 is connectable to an A/C power source 36 via a first input node 38 and a second input node 40, and is configured to provide a DC voltage level at an output node 42. Resonant heating circuit 24 is coupled between rectifier output node 42 and a node 44, and power switch 26 is coupled between node 44 and a ground node 46. Pulse controller 28 is configured to provide a switch control signal to power switch 26 via a path 48 to cause power switch 26 to first close and then, after a predetermined duration, to open to thereby provide a DC pulse to resonant heating circuit 24. The predetermined duration is based on a maximum energy value that resonant heating circuit 24 can store without sustaining damage. Resonant heating circuit 24 generates an oscillating voltage and an associated oscillating current and alternating magnetic flux in response to the DC pulse to thereby to heat inductively coupled external load 34.

Pulse initiator 30 is coupled in parallel with and configured to monitor a voltage across power switch 26. Pulse initiator 30 is further configured to provide a pulse initiation signal to pulse controller 30 via a path 50 to cause pulse controller 25 to initiate application of a subsequent DC pulse to resonant heating circuit 24 when a voltage across power switch 26 is substantially equal to zero during a first cycle of the oscillating voltage. By closing power switch 26 when the voltage across power switch 26 is at substantially equal to zero during the first cycle of oscillating voltage, induction heating system 30 according to the present invention both substantially maximizes the heating of external load 34 and substantially minimizes switching stress of power switch 26.

Figure 2:
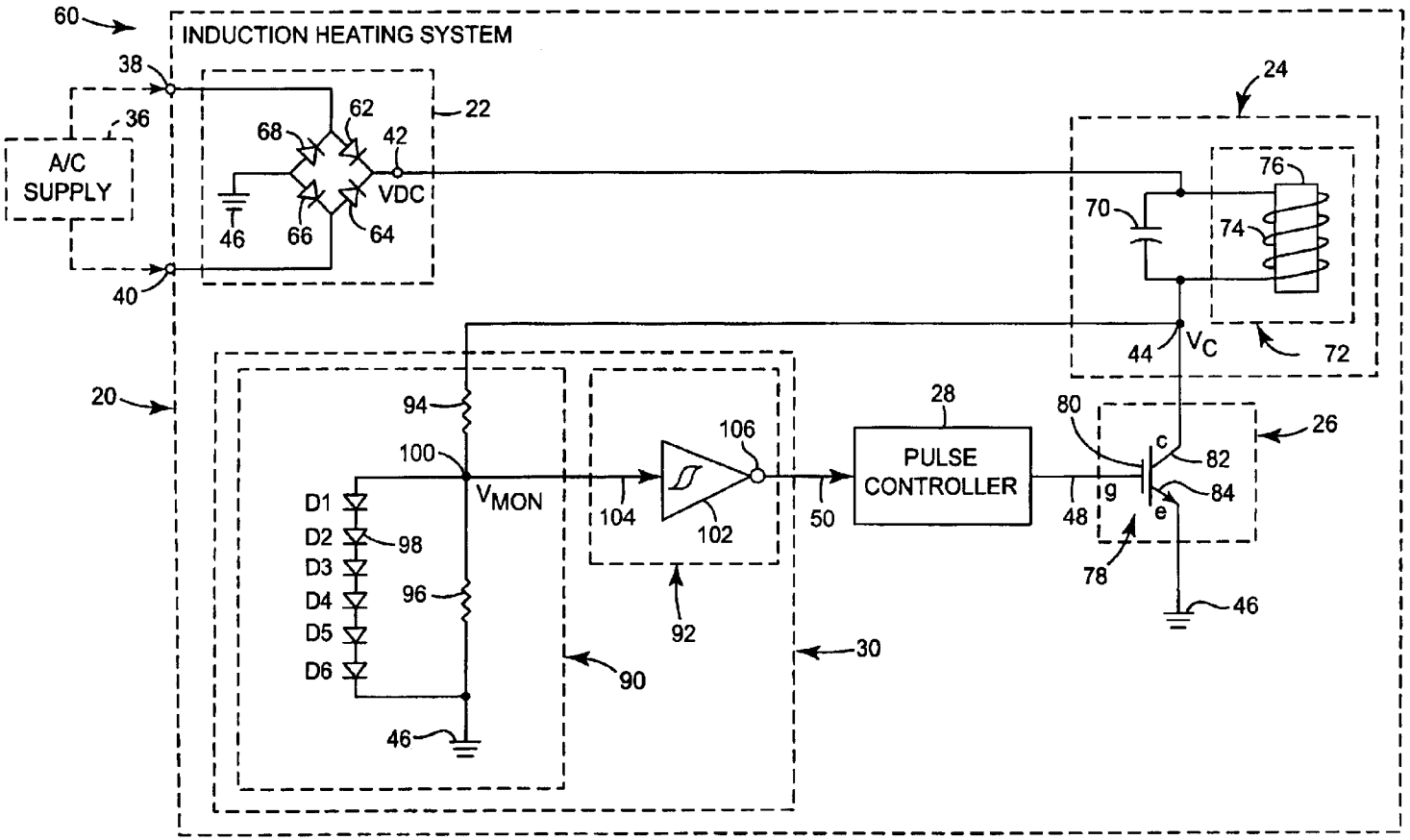
FIG. 2 is a schematic and block diagram illustrating one exemplary embodiment of an induction heating system according to the present invention.

FIG. 2 is a schematic and block diagram 60 illustrating one exemplary embodiment of induction heating system 20 according to the present invention. Rectifier 22 is a standard diode bridge rectifier comprising four diodes 62, 64, 66, and 68. First diode 62 has an anode coupled to first input node 38 and a cathode coupled to output node 42. Second diode 64 has an anode coupled to second input node 40 and a cathode coupled to output node 42. Third diode 66 as an anode coupled to ground 46 and a cathode coupled to first input node 38. Fourth diode 68 has an anode coupled to ground 46 and a cathode coupled to second input node 40. Rectifier 22 is connectable to external A/C supply 36 and configured to provide a DC voltage level at output node 42.

Resonant heating circuit 24 comprises a resonant capacitor 70 and a working head 72 comprising an inductive heating coil 74 wrapped around a ferrite core 76. Resonant capacitor is coupled in parallel with inductive heating coil 74 and has a first terminal coupled to rectifier output node 42 and a second terminal coupled to node 44. Resonant heating circuit 24 generates an oscillating voltage and an associated oscillating current and alternating magnetic flux in ferrite core 76 in response to a DC voltage pulse to thereby to heat inductively coupled external load 34. In one embodiment, working head 72 is coupled to resonant capacitor 70 using flexible leads that enable working head 72 to be moveable with respect to inductive heating system 20 and to be placed in contact with remote loads that are to be heated, such as load 34. In one embodiment, working head 72 does not include a ferrite core 76.

Power switch 26 comprises an insulated gate bipolar transistor (IGBT) having a gate 80, a collector 82 coupled to node 44, and an emitter coupled to ground 46. In other embodiments, power switch 26 comprises a field effect transistor (FET), a bipolar junction transistor (BJT), or a silicon controlled rectifier (SCR). Pulse controller 28 is configured to provide a switch control signal to power switch 26 via path 48 to cause power switch 26 to first close and then, after a predetermined duration, open to thereby provide the DC voltage pulse to resonant heating circuit 24. The predetermined duration is based on a maximum energy value that resonant heating circuit 24 can store before sustaining damage. Pulse controller 28 is configured to close power switch 26 after initial power-up of induction heating system 20 to thereby initiate a first DC voltage pulse to resonant heating circuit 24, and to thereinafter close power switch 26 to initiate subsequent DC voltage pulse to resonant heating circuit 24 based on receipt of the pulse initiation signal via path 50 from pulse initiator 30.

Pulse initiator 30 is coupled in parallel with power switch 26 and comprises a voltage divider 90 and a level switch 92. Voltage divider 90 comprises a dropping resistor 94, a monitoring resistor 96, and a plurality of diodes 98. Dropping resistor 94 has first terminal coupled to node 44 and a second terminal coupled to a monitoring node 100. Monitoring resistor 96 is coupled between monitoring node 100 and ground 46. The plurality of diodes 100 are series connected cathode-to-anode and coupled in parallel with monitoring resistor 96 with an anode of a first diode of the plurality coupled to monitoring node 100 and a cathode of the last diode of the plurality coupled to ground 46, and function to limit a voltage across monitoring resistor 96 to a maximum level.

When power switch 26 is in a closed position, node 44 is brought to ground which effectively removes pulse initiator 30 from the system while a DC voltage pulse is being applied to resonant heating circuit 24. When the DC voltage pulse is removed from resonant circuit 24 by opening power switch 26, resonant heating circuit 24 begins to generate an oscillating voltage. The sum of the DC voltage level at DC output node 42 and the oscillating voltage generated by resonant circuit 24 is present at node 44, or collector 82, to ground 46, and is hereinafter referred to as $V_C$ (voltage at collector 82 to ground). When resonant heating circuit 24 is generating the oscillating voltage, $V_C$ appears as an oscillating waveform having a DC offset substantially equal to the DC voltage level at DC output node 42. $V_C$ is also present across dropping resistor 94 and monitoring resistor 96 of voltage divider 90, with the majority of the voltage appearing across dropping resistor 94 and a monitoring voltage appearing across monitoring resistor 96 from monitoring node 100 to ground 46. As $V_C$ oscillates, so does the monitoring voltage across monitoring resistor 96. VC is further illustrated in graphical form below by FIG. 3.

Level switch 92 is an inverting complimentary metal oxide semiconductor (CMOS) Schmitt trigger 102 having an input 104 coupled to monitoring node 100 and receiving the monitoring voltage, and an output 106 coupled to pulse controller 28 via path 28. Schmitt trigger 102 is configured with hysteresis so as to have a low voltage set-point and a high voltage set-point. Schmitt trigger 102 is configured to compare the monitoring voltage to the low and high voltage set-points and to provide at output 106 the pulse initiation signal causing pulse controller 28 to initiate application of a subsequent DC pulse to resonant circuit 24 when the monitoring voltage is substantially equal to low voltage set-point. In one embodiment, the low voltage set-point is a predetermined value incrementally greater than zero, such that when taking into account inherent propagation delays involved in pulse initiator 30 providing the pulse initiation signal to pulse controller 28 and pulse controller 28 providing the switch control signal to power switch 26, power switch 26 actually closes when the monitoring voltage, and thus $V_C$, has a value substantially equal to zero.

Figure 3:
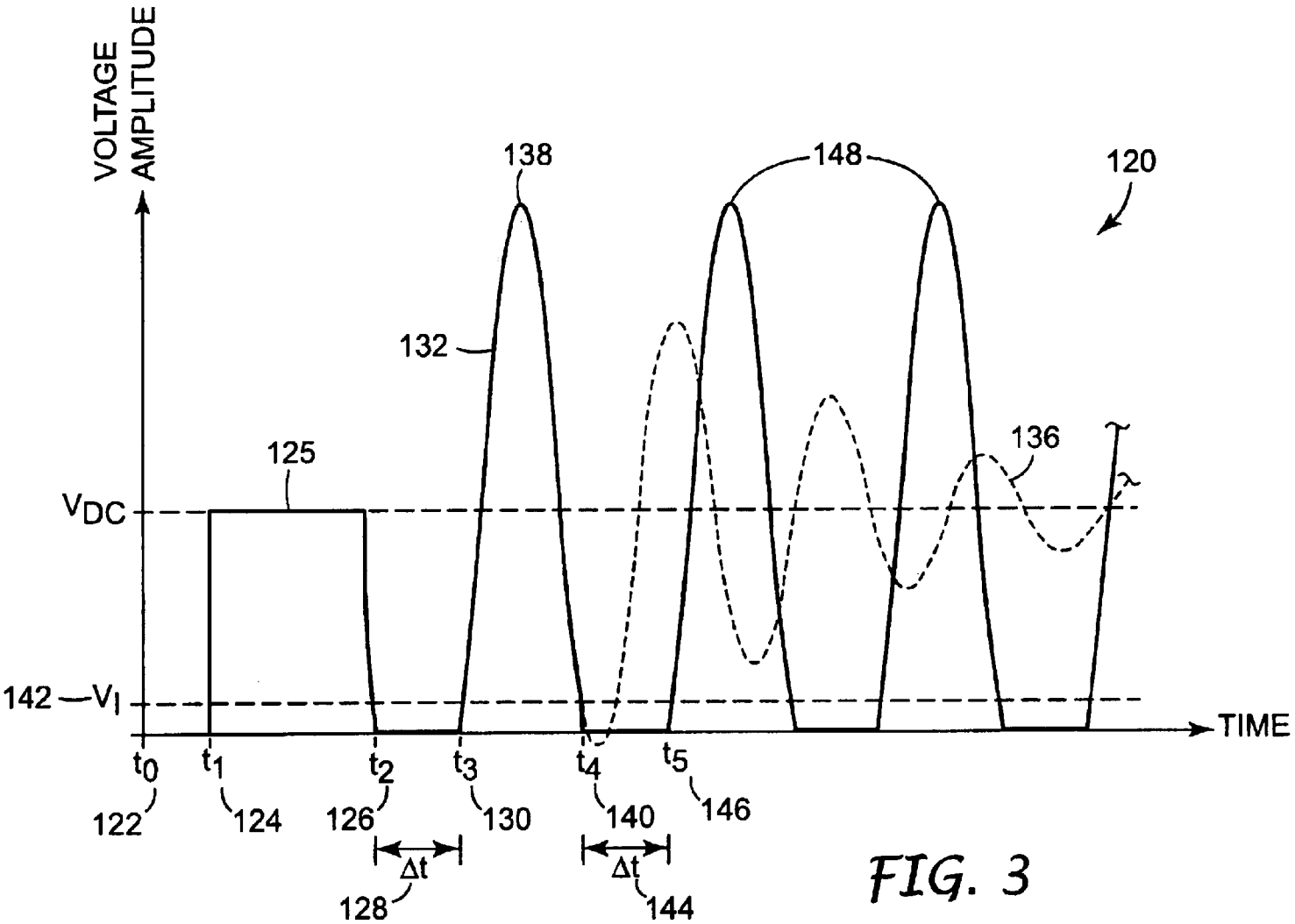
FIG. 3 is an exemplary graph of the voltage across a power switch of an induction heating system according to one embodiment of the present invention.

FIG. 3 is an exemplary graph 120 of the voltage across power switch from the collector 82 to ground, hereinafter referred to as $V_C$, and is included to aid in describing the operation of induction heating system 20. At time $t_0$, with no A/C source applied to first and second input nodes 38 and 40, $V_C$ is equal to zero, as indicated at 122. At time t1, as indicated at 124, A/C supply 36 is applied across first and second input nodes 38 and 40, resulting in rectifier 22 providing a DC voltage level ($V_{DC}$) and producing a DC voltage substantially equal to $V_{DC}$ from collector 82 to ground 46. After the initial power-up of induction heating system 20, pulse controller 28 is configured to provide a power switch control signal to gate 80 via line 110 to cause IGBT 78 to become forward-biased and pull collector 82 to ground 46 via emitter 84, as indicated at time $t_2$ at 126. Pulse controller 28 is configured to maintain IGBT 78 in a forward-biased condition for a duration ($\Delta t$) 128 from $t_2$ to time $t_3$. During this duration, collector 82 is shorted to ground 46 via emitter 84, resulting in a DC voltage pulse having a magnitude substantially equal to $V_{DC}$ and duration of $\Delta t$ to be applied across resonant heating circuit 24 and causing a charge to accumulate in inductive coil 74. The duration $\Delta t$ 128 determines the magnitude of the accumulated charge in inductive coil 74.

At time $t_3$, as indicated at 130, pulse controller 28 provides a power switch control signal to gate 80 to cause IGBT 78 to become reverse-biased causing IGBT 78 to no longer conduct to ground and thereby terminate the DC voltage pulse to resonant circuit 24. At $t_3$ 130, inductive coil 74 begins to discharge into resonant capacitor 70 and resonant heating circuit 24 begins generating an oscillating voltage which in-turn generates a corresponding oscillating flux in ferrite core 76 to heat external load 34. The oscillating voltage generated by resonant heating circuit 24 combines with $V_{DC}$ to form an oscillating voltage having a DC-offset substantially equal to $V_{DC}$ across power switch 26 from collector 82 to ground 46, as indicated at 132. If no additional DC pulses are applied to resonant heating circuit 24, the oscillating waveform across power switch 26 would gradually decay, or "ring-out," around the DC-offset as indicated by the dashed waveform 136.

However, when power switch 26 is opened at $t_3$ 130, voltage $V_C$ is provided from node 44 to ground 46 and thus, across dropping resistor 94 and monitoring resistor 96 and thereby providing the monitoring voltage ($V_{MON}$) at input 104 of CMOS Schmitt trigger 102. As $V_C$ rises from a value of substantially zero volts at $t_3$ 130 to a peak value 138, the voltage across monitoring resistor 96 rises, but is limited to a maximum value as dictated by limiting diodes 98. As $V_C$ passes peak value 138, the value of $V_C$ drops to point where limiting diodes 98 are no longer forward-biased and dropping resistor 94 and biasing resistor 96 function as a conventional voltage divider.

$V_C$ continues to drop until, at time $t_4$ at 140, it reaches an initiation voltage level ($V_1$), as indicated at 142, at which point $V_{MON}$ at input 104 is substantially equal to the low-voltage set-point of Schmitt trigger 102. When VMON is substantially equal to the low-voltage set-point, Schmitt trigger 102 provides at output 106 a pulse initiation signal to pulse controller 28 via path 50 causing pulse controller 28 to provide a switch control signal to gate 80, which in-turn causes IGBT 78 to close to thereby initiate a subsequent DC pulse to resonant heating circuit 24. Pulse controller 28 maintains IGBT 78 in a forward-biased condition for a second duration ($\Delta t$), indicated at 144, from $t_4$ 140 to $t_5$, indicated at 146, to thereby apply the subsequent DC pulse to resonant heating circuit 24. The above described process is then repeated as necessary to heat load 34, resulting in $V_C$ having a voltage waveform comprising a series of peaks as indicated by peaks 138 and 148.

Numerous characteristics and advantages of the invention have been set forth in the foregoing description. It will be understood, of course, that this disclosure is, and in many respects, only illustrative. Changes can be made in details, particularly in matters of shape, size and arrangement of parts without exceeding the scope of the invention. The invention scope is defined in the language in which the appended claims are expressed.

What is claimed is:

1. An induction heating system comprising:

a power switch configured to provide DC voltage pulses;

a resonant heating circuit configured to generate an oscillating voltage in response to a DC voltage pulse input; and a pulse initiator positioned across the power switch and configured to monitor a voltage across the power switch and to initiate application of a subsequent DC voltage pulse to the resonant heating circuit upon detecting a substantially zero voltage across the power switch during a first cycle of the oscillating voltage.

2. The induction heating system of claim 1, wherein the power switch is configured to close and open to provide the DC voltage pulses.

3. The induction heating system of claim 2, wherein the power switch is configured to open and close in response to a switch control signal.

4. The induction heating system of claim 3, further comprising:

a pulse controller positioned between the pulse initiator and the power switch and configured to provide the switch control signal to the power switch, wherein the switch control signal causes the power switch to close in response to the pulse initiator detecting a substantially zero voltage across the power switch during a first cycle of the oscillating voltage and to open after a duration to thereby apply the subsequent DC voltage pulse to the resonant heating circuit.

5. The induction heating system of claim 4, wherein the duration is fixed at a value substantially equal to a maximum allowable duration that is a predetermined value based on a maximum energy storage capacity of the resonant heating circuit.

6. The induction heating system of claim 1, wherein the pulse initiator comprises:

a voltage divider positioned across the power switch and configured to provide a monitoring voltage representative of a voltage across the power switch; and a level switch configured to receive the monitoring voltage and to initiate application of the subsequent DC voltage pulses when a level of the monitoring voltage is substantially equal to a predetermined positive threshold level.

7. The induction heating system of claim 6, wherein the voltage divider comprises a first resistor and a second resistor series connected across the voltage switch wherein the monitoring voltage is a voltage across the second resistor; and a plurality of diodes series connected anode to cathode across the second resistor that functions to limit the voltage across the second resistor so as not to damage the level switch.

8. The induction heating system of claim 7, wherein the diodes comprise high-speed switching breakdown diodes having a low capacitance.

9. The induction heating system of claim 1, wherein the resonant heating circuit comprises:

a resonant capacitor; and an induction heating coil coupled in parallel with the resonant capacitor.

10. The induction heating system of claim 1, wherein the power switch comprises an insulated gate bipolar transistor (IGBT) having a gate, a collector, and an emitter.

11. A method of operating an inductive heating system comprising:

operating a power switch to apply a DC voltage pulse across a resonant circuit wherein a pulse initiator is positioned across the power switch and configured to monitor a voltage across the power switch and to initiate application of a subsequent DC voltage pulse to the resonant heating circuit upon detecting a substantially zero voltage across the power switch during a first cycle of the oscillating voltage;

generating with the resonant circuit an oscillating voltage in response to the DC voltage pulse;

applying a subsequent DC voltage pulse to the resonant circuit upon detecting a substantially zero voltage across the power switch during a first cycle of the oscillating voltage.

12. The method of claim 11, wherein operating the power switch comprises:

closing and opening the power switch.

13. The method of claim 11, wherein detecting the substantially zero voltage across the power switch comprises:

providing a monitoring voltage representative of a voltage across the power switch;

closing the power switch when the monitoring voltage is substantially equal to a predetermined threshold value.

14. An induction heating system connectable to an AC source, the system comprising:

a rectifier connectable to the AC source and configured to provide a DC voltage at a DC output node;

a power switch having a first terminal, a second terminal coupled to ground, and a control gate;

a resonant heating circuit coupled between the DC output node and the first terminal of the power switch;

a pulse controller configured to provide a control signal to the power switch control gate to close and open the switch to thereby provide a DC voltage pulse to the resonant circuit and causing the resonant circuit to generate an oscillating voltage; and a pulse initiator coupled across the power switch terminals and configured to monitor an oscillating voltage across the power switch and to provide a control signal to the pulse controller instructing the pulse controller to close the power switch when the oscillating voltage across the power switch reaches a predetermined threshold value such that when the switch closes the voltage across the power switch is substantially equal to zero.

15. The induction heating system of claim 14, wherein the power switch comprises:

an insulated gate bipolar transistor having a gate configured to receive a control voltage, a collector coupled to the resonant circuit, and an emitter coupled to ground.

16. The induction heating system of claim 14, wherein the pulse initiator comprises:

a voltage divider circuit coupled across the power switch terminals and configured to provide a monitoring voltage representative of oscillating voltage across the power switch; and a level switch configured to receive the monitoring voltage and to provide the control signal to the pulse controller when a level of the monitoring voltage is substantially equal to the predetermined threshold value.

17. The induction heating system of claim 16, wherein the voltage divider comprises:

a monitoring node coupled to the level switch;

a first resistor coupled between the first terminal of the power switch and the monitoring node;

a second resistor coupled between the monitoring node and ground, wherein a voltage across the second resistor is the monitoring voltage; and a plurality of diodes connected in series with an anode of a first series connected diode coupled to the monitoring node and a cathode of a last series connected diode coupled to ground, wherein the diodes limit the voltage across the second resistor.

18. The induction heating system of claim 17, wherein the diodes comprise high-speed switching breakdown diodes having a low capacitance.

19. The induction heating system of claim 16, wherein the level switch comprises:

an inverting CMOS trigger with hysteresis and having a low threshold voltage substantially equal to the predetermined threshold value and a high threshold value.

20. The induction heating system of claim 14, wherein the resonant circuit comprises:

a parallel resonant circuit comprising:

a capacitor having a first terminal coupled to the DC output node and a second terminal coupled to the first terminal of the power switch; and an inductive heating coil coupled in parallel with the capacitor.

21. The induction heating system of claim 20, wherein the inductive heating coil is inductively coupleable to a working head.

22. The induction heating system of claim 14, wherein the pulse controller is further configured to open the switch after a predetermined maximum duration wherein the maximum duration is based on a maximum energy storage capacity of the resonant heating circuit.

23. The induction heating system of claim 14, wherein the pulse controller is configured to close the power switch based on an initial power-up of the induction heating system and to thereafter close the switch based on the pulse initiator control signal.

* * * * *

UNITED STATES PATENT AND TRADEMARK OFFICE

CERTIFICATE OF CORRECTION

PATENT NO. : 6,943,329 B2
DATED : September 13, 2005
INVENTOR(S) : Ring

It is certified that error appears in the above-identified patent and that said Letters Patent is hereby corrected as shown below:

Column 5,
Line 26, delete "($V_1$)" and insert -- ($V_l$) --, therefor.

Column 6,
Line 29, after "comprises" insert -- : --.

Signed and Sealed this

Twenty-second Day of November, 2005

JON W. DUDAS
*Director of the United States Patent and Trademark Office*